US011326589B2

(12) United States Patent
Leonard, II

(10) Patent No.: US 11,326,589 B2
(45) **Date of Patent: *May 10, 2022**

(54) LINEAR HYDRAULIC PUMP AND ITS APPLICATION IN WELL PRESSURE CONTROL

(71) Applicant: Schlumberger Technology Corporation, Sugar Land, TX (US)

(72) Inventor: Thomas Eugene Leonard, II, Holly Springs, NC (US)

(73) Assignee: Schlumberger Technology Corporation, Sugar Land, TX (US)

( * ) Notice: Subject to any disclaimer, the term of this patent is extended or adjusted under 35 U.S.C. 154(b) by 29 days.

This patent is subject to a terminal disclaimer.

(21) Appl. No.: 16/691,534

(22) Filed: Nov. 21, 2019

(65) Prior Publication Data

US 2020/0088187 A1 Mar. 19, 2020

Related U.S. Application Data

(63) Continuation of application No. 15/145,616, filed on May 3, 2016, now Pat. No. 10,533,548.

(51) Int. Cl.

| | |
|---|---|
| ***F04B 47/04*** | (2006.01) |
| ***F04B 47/02*** | (2006.01) |
| ***F04B 9/105*** | (2006.01) |
| ***E21B 21/10*** | (2006.01) |
| ***E21B 43/20*** | (2006.01) |
| ***F04B 49/08*** | (2006.01) |
| ***F04B 49/03*** | (2006.01) |
| ***F04B 9/10*** | (2006.01) |
| ***F04B 49/06*** | (2006.01) |
| ***F04B 23/02*** | (2006.01) |
| ***F04B 23/04*** | (2006.01) |
| ***E21B 21/08*** | (2006.01) |
| ***E21B 43/118*** | (2006.01) |

(52) U.S. Cl.

CPC ..... *F04B 47/04* (2013.01); *E21B 21/08* (2013.01); *E21B 21/106* (2013.01); *E21B 43/118* (2013.01); *E21B 43/20* (2013.01); *F04B 9/10* (2013.01); *F04B 9/105* (2013.01); *F04B 23/02* (2013.01); *F04B 23/04* (2013.01); *F04B 47/02* (2013.01); *F04B 49/03* (2013.01); *F04B 49/065* (2013.01); *F04B 49/08* (2013.01)

(58) Field of Classification Search

CPC ..... F04B 47/02; F04B 47/04; F04B 9/105; F04B 9/10; F04B 49/08; F04B 49/065; E21B 21/08; E21B 21/106

See application file for complete search history.

(56) References Cited

U.S. PATENT DOCUMENTS

| | | | |
|---|---|---|---|
| 3,198,250 | A | 8/1965 | Hoch et al. |
| 4,470,771 | A | 9/1984 | Hall et al. |

(Continued)

*Primary Examiner* — Christopher S Bobish

(74) *Attorney, Agent, or Firm* — Kelly McKinney

(57) ABSTRACT

An apparatus includes a linear motor and a fluid pump functionally connected to the linear motor. A fluid inlet of the fluid pump is in fluid communication with a fluid source. A fluid outlet of the fluid pump in fluid communication with a well. A pressure sensor is in fluid communication with the well. A controller is functionally coupled to the linear motor and the pressure sensor, wherein the controller is configured to operate the fluid pump to maintain a selected pressure in the well.

18 Claims, 2 Drawing Sheets

(56) References Cited

U.S. PATENT DOCUMENTS

| | | | | |
|---|---|---|---|---|
| 4,541,779 | A | 9/1985 | Birdwell | |
| 5,616,009 | A | 4/1997 | Birdwell | |
| 6,454,542 | B1 | 9/2002 | Back | |
| 6,904,981 | B2 | 6/2005 | van Riet | |
| 7,757,784 | B2 | 7/2010 | Fincher et al. | |
| 8,490,719 | B2 | 7/2013 | Duhe et al. | |
| 8,567,525 | B2 | 10/2013 | Reitsma | |
| 9,366,248 | B2 | 6/2016 | Marica | |
| 9,435,162 | B2 | 9/2016 | Duhe et al. | |
| 9,725,974 | B2 | 8/2017 | Lovorn | |
| 9,797,196 | B2 | 10/2017 | Taggart et al. | |
| 2001/0013426 | A1 | 8/2001 | Wilson et al. | |
| 2002/0112888 | A1* | 8/2002 | Leuchtenberg | E21B 21/08 175/48 |
| 2003/0079912 | A1 | 5/2003 | Leuchtenberg | |
| 2003/0098181 | A1 | 5/2003 | Aronstam et al. | |
| 2007/0227774 | A1 | 10/2007 | Reitsma et al. | |
| 2010/0186960 | A1 | 7/2010 | Reitsma et al. | |
| 2011/0123363 | A1* | 5/2011 | Marica | F04B 5/00 417/279 |
| 2012/0292109 | A1* | 11/2012 | Lovorn | E21B 21/08 175/25 |
| 2015/0308420 | A1 | 10/2015 | Donnally et al. | |
| 2015/0361743 | A1 | 12/2015 | Mikkulainen | |
| 2018/0023346 | A1 | 1/2018 | Taggart et al. | |
| 2018/0135365 | A1* | 5/2018 | Knudsen | E21B 21/08 |

* cited by examiner

LINEAR HYDRAULIC PUMP AND ITS APPLICATION IN WELL PRESSURE CONTROL

CROSS-REFERENCE TO RELATED APPLICATIONS

This application is a continuation of U.S. application Ser. No. 15/145,616, which was filed May 3, 2016. The patent application identified above is incorporated herein by reference in its entirety.

BACKGROUND

This disclosure relates to the field of well drilling. More specifically, the disclosure relates to pumps used to maintain fluid pressure in a well during drilling operations.

U.S. Pat. No. 6,904,981 issued to van Riet describes a well pressure control system that may be used in the construction of subsurface wells. The function of the well pressure control system disclosed in the van Riet '981 patent is to maintain fluid pressure in the well higher than the hydrostatic pressure exerted by a column of fluid of a selected density at any true vertical depth in the well. Such fluid pressure is maintained by a controllable orifice choke disposed in a fluid outlet or discharge conduit from the well, where the well is closed to fluid flow other than through a drill string disposed in the well and the fluid outlet or discharge conduit. The controllable orifice choke provides a backpressure to the well resulting from restriction of fluid flow out of the well when fluid is pumped into the well through the drill string. During times when fluid is not pumped into the drill string, a backpressure pump or flow diverted from drilling rig mud pumps to the fluid outlet or fluid discharge conduit may be used to maintain a selected backpressure, and consequent selected fluid pressure in the well. Maintaining fluid pressure may require pumping additional fluid into the well using a backpressure pump or diverted flow from the drilling rig mud pumps in particular during "tripping" operations, where the drill string is withdrawn from the well. Withdrawal of the drill string from the well reduces the amount of well fluid displaced by the drill string, thus enabling the well fluid pressure to decrease; thus additional fluid may be pumped into the well to maintain the fluid pressure. Separate backpressure pumps may be preferable in some circumstances because they may be more accurately controlled than the drilling rig mud pumps. There is a need for improved backpressure pumps to enable more precise well pressure control.

DETAILED DESCRIPTION

Figure 1:
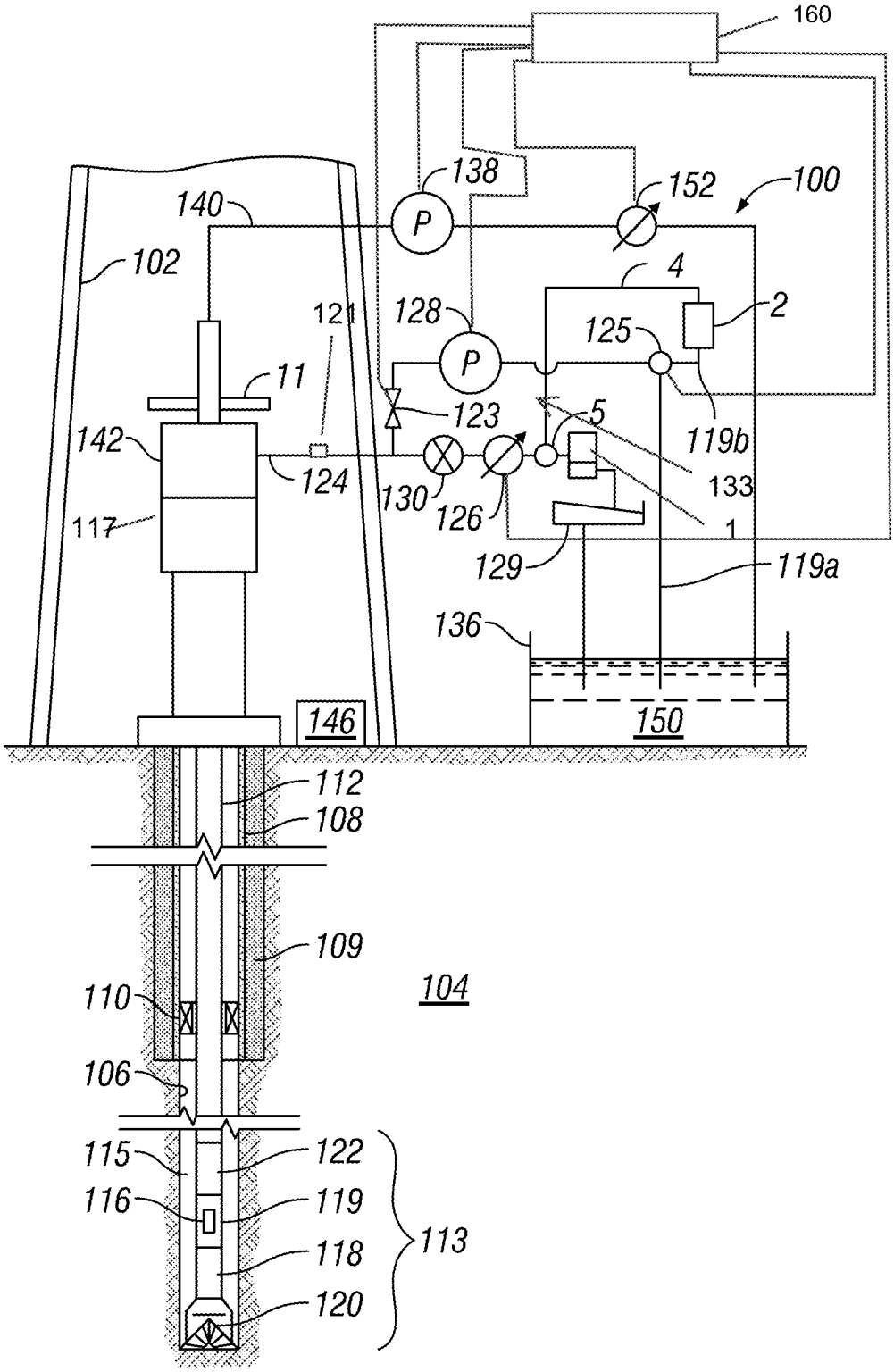
FIG. 1 shows an example embodiment of a well drilling system that may be used with various implementations of a pump according to the present disclosure.

FIG. 1 shows a well drilling system 100, which may be a land-based drilling system or a marine drilling system having a well pressure control system known as "a dynamic annular pressure control" (DAPC) system that may have a pump in accordance with the present disclosure. The example embodiment of the well drilling system 100 is shown including a drilling rig 102 placed on the land surface

146 that is used to support drilling operations. Some of the components used on the drilling rig 102, such as a kelly or top drive, power tongs, slips, draw works and other equipment are not shown separately in the figures for clarity of the illustration. The drilling rig 102 is used to support a drill string 112 used for drilling a well 106 through subsurface formations such as that shown by reference numeral 104. As shown in FIG. 1 the well 106 has already been partially drilled, and a protective pipe or casing 108 set and cemented 109 into place in part of the drilled portion of the well 106. In the present embodiment, a casing shutoff mechanism or downhole deployment valve 110 may be installed in the protective pipe or casing 108 to selectively hydraulically isolate an annulus 115 between the drill string 112 and the protective pipe or casing 108 and effectively act as a valve to stop flow of fluid from the open hole section of the well 106 (the portion of the well 106 below the bottom of the protective pipe or casing 108) when a drill bit 120 at the bottom of the drill string 112 is located above the downhole deployment valve 110.

The drill string 112 supports a bottom hole assembly ("BHA") 113 that may include the drill bit 120, a mud motor 118, a measurement-while-drilling and logging-while-drilling (MWD/LWD) sensor assembly 119 that in some embodiments includes a pressure transducer 116 to measure the fluid pressure in the annulus 115. The drill string 112 may include a check valve (not shown) to prevent backflow of fluid from the annulus 115 into the interior of the drill string 112. The MWD/LWD sensor assembly 119 may include a telemetry package 122 that is used to transmit pressure data as measured by the pressure transducer 116, data from the MWD/LWD sensor assembly 119, as well as drilling information to be received at the Earth's surface. Such transmission may be performed by a fluid flow modulator (not shown separately) controlled by the MWD/LWD sensor assembly 119 so as to generate changes in flow rate and/or pressure of fluid (explained below) pumped through the drill string 112. Such changes may be detected at the surface and decoded into measurements made by the various sensors disposed in the drill string 112. While FIG. 1 is directed to a telemetry package 122 having a fluid flow modulation telemetry system, it will be appreciated that other telemetry systems, such as radio frequency (RF), electromagnetic (EM) or drill string transmission systems may be used in other embodiments.

The drilling process uses a fluid, which may be a fluid suspension referred to as "drilling mud" that may be stored at the surface in a reservoir 136. The reservoir 136 is in fluid communications with one or more rig mud pumps 138 which pump the drilling mud 150 through a conduit 140. The conduit 140 is connected to the uppermost segment or "joint" of the drill string 112 that passes through a rotating control device 142 such as a rotating diverter, rotating control head or rotating blowout preventer ("BOP"). The rotating control device urges seals (not shown separately) for example, spherically shaped elastomeric sealing elements, to rotate upwardly, closing around the drill string 112 and isolating the fluid pressure in the annulus 115, but still enabling rotation of the drill string 112. Commercially available rotating BOPs, such as those manufactured by National Oilwell Varco, 10000 Richmond Avenue, Houston, Tex. 77042 are capable of isolating pressure in the annulus 115 up to 10,000 psi (68947.6 kPa).

The drilling mud 150 is pumped down through an interior passage in the drill string 112 and the BHA 113 and exits through nozzles or jets in the drill bit 120, whereupon the drilling mud 150 enters the annulus 115 and circulates drill cuttings away from the drill bit 120. The movement of drilling mud 150 in the annulus 115 also returns drill cuttings upwardly through the annulus 115. The drilling mud 150 ultimately returns to the surface and moves through a flow diverter 117 in the rotating control device 142, through a return conduit 124 and various surge tanks and telemetry receiver systems (not shown separately).

Thereafter the drilling mud 150 proceeds to what is generally referred to herein as a backpressure system 133. The drilling mud 150 may enter the backpressure system 133 through the return conduit 124 and may pass through a controllable orifice choke 130 and then through a flowmeter 126. The flowmeter 126 may be a mass-balance type or other high-resolution flowmeter. Using measurements from the flowmeter 126, a system operator may be able to determine differences between how much drilling mud 150 has been pumped into the well 106 through the drill string 112, and how much drilling mud 150 returns from the well 106. Based on any determined differences between the amount of drilling mud 150 pumped into the drill string 112 and the amount of drilling mud 150 returned, the system operator may determine whether drilling mud 150 is being lost to the formation 104, which may indicate that formation fracturing or breakdown has occurred, i.e., a significant negative fluid differential. Conversely, a determined difference wherein more fluid leaves the well 106 than the amount of drilling mud 150 pumped into the drill string 112 be indicative of formation fluid entering into the well 106 from the formations 104.

It will be appreciated that there exist chokes designed to operate in an environment where the drilling mud 150 contains substantial amounts of drill cuttings and other solids. The controllable orifice choke 130 may be of a wear resistant type and may be further capable of operating at variable pressures, variable openings or apertures, and through multiple duty cycles. The drilling mud 150 then exits the controllable orifice choke 130, through the flowmeter 126 and flows through a three way valve 5. The drilling mud 150 leaving the three way valve 5 for cleaning and return to the reservoir 136 may then be processed by an optional degasser 1 and by a series of filters and a shaker table, shown collectively at 129, designed to remove contaminants, including drill cuttings, from the drilling mud 150. The drilling mud 150 is then returned to the reservoir 136. During "tripping operations", explained further below, the three way valve 5 may be operated to direct fluid from the return conduit 124 to a trip tank fill conduit 4 and thence into a trip tank 2.

A backpressure system intake conduit 119*a* may have one end disposed in the reservoir 136 and may be selectively placed in fluid communication with one port of a three-way valve 125 for conducting drilling mud 150 to the inlet of a backpressure pump 128. The inlet of the backpressure pump 128 may be selectively placed in fluid communication with a trip tank 2 using the three way valve 125 connected to the trip tank 2 by a trip tank conduit 119*b*. An outlet of the backpressure pump 128 may be in fluid communication with the return conduit 124 through an isolation valve 123.

The trip tank 2 is used in a drilling system to monitor drilling fluid gains and losses during tripping operations (withdrawing and inserting the full drill string 112 or substantial subset thereof from the well 106). The three-way valve 125 may be used to selectively place the inlet of the backpressure pump 128 in fluid communication with the backpressure system intake conduit 119*a*, the trip tank conduit 119*b* or to isolate the backpressure system 133 from fluid communication with any other components. To isolate the backpressure system 133, the isolation valve 123 may be closed and the three way valve 125 may isolate both the backpressure system intake conduit 119*a* and the trip tank conduit 119*b* from the inlet of the backpressure pump 128.

In the present example embodiment, the backpressure pump 128 is capable of using returned drilling mud 150 to create a backpressure in the well 106 by operating the three way valve 125 to place the inlet of the backpressure pump 128 in fluid communication with the trip tank conduit 119*b*. It will be appreciated that the returned drilling mud 150 could have contaminants that would not have been removed by the filter/shaker table 129. In such case, wear on backpressure pump 128 may be increased. To reduce such wear, fluid supply for the backpressure pump 128 may be provided through the backpressure system intake conduit 119*a* from the reservoir 136 to provide reconditioned drilling mud to the inlet of the backpressure pump 128.

The three-way valve 125 may be operated to selectively couple the inlet of the backpressure pump 128 to either the backpressure system intake conduit 119*a* or the trip tank conduit 119*b*. The backpressure pump 128 may then be operated to ensure sufficient flow passes through the controllable orifice choke 130 and thence into the well 106 through the return conduit 124 to be able to maintain a selected fluid pressure in the annulus 115, even when there is no drilling mud 150 being pumped into the drill string 112. In particular, during tripping operations, as the drill string 112 is withdrawn from the well 106, the volume of drilling mud 150 in the well 106 displaced by the drill string 112 is reduced. Such reduction in displaced volume will result in reduction of fluid pressure in the well 106. One function of the backpressure system 133, among others, is to maintain the fluid pressure in the well 106 during tripping operations.

The well drilling system 100 may include a flow meter 152 in conduit 100 to measure the amount of drilling mud 150 being pumped into the drill string 112. It will be appreciated that by monitoring the flow meters 126, 152 and thus the volume pumped by the backpressure pump 128, it is possible to determine the amount of drilling mud 150 being lost to the formation, or conversely, the amount of formation fluid entering to the borehole 106. In some embodiments, fluid pressure in the well 106 may be determined by measuring pressure in the return conduit 124, e.g., by using a pressure sensor 121 in fluid communication with the return conduit 124.

Operation of the three way valve 125, the back pressure pump 128, the controllable orifice choke 130, the isolation valve 123 and three way valve 5 may be effected by a controller 160. The controller 160 may be a programmable logic controller (PLC), a microprocessor or any similar device which may accept as input signals from the pressure sensor 121, the flowmeters 126, 152 and, e.g., a stroke counter (not shown) on the rig mud pumps 138 to operate the three way valve 125, the back pressure pump 128, the controllable orifice choke 130, the isolation valve 123 and three way valve 5 to maintain a selected fluid pressure in the well 106.

Having explained an example embodiment of a well drilling system including a backpressure system, an example embodiment of the backpressure pump 128 will be explained with reference to FIG. 2. The backpressure pump 128 may be a vertically oriented, linear motion pump. The backpressure pump 128 may include a linear motor 201 which operates a connecting rod 204 longitudinally in a reciprocating motion. In the present example embodiment, the linear motor 201 may be a reciprocating hydraulic actuator. The reciprocating hydraulic actuator may comprise an hydraulic cylinder 200 which may be divided into two fluid chambers 200A, 200B separated by a fluid barrier 206, such as a piston. The fluid barrier 206 converts fluid movement into one of the pumping chambers 200A, 200B and discharge of fluid from the other one of the pumping chambers 200B, 200A into a mechanical output of the linear motor. The fluid barrier 206 may be functionally coupled to the connecting rod 204 such that pumping fluid, such as hydraulic oil into one fluid chamber 200A causes movement of the fluid barrier 206 in one direction (and corresponding movement of the connecting rod 204) and causes the fluid to be discharged from the other fluid chamber 200B. Pumping fluid into the other fluid chamber 200B will cause opposite operation of the linear motor 201.

The fluid may be supplied under pressure by an hydraulic fluid pump 210. An outlet and an inlet of the hydraulic fluid pump 210 may be in fluid communication with a proportional output solenoid valve 212. The proportional output solenoid valve 212 may have inlet and outlet ports configured to direct a selected fractional amount of the fluid output from the hydraulic pump 210 to one of two fluid lines 214, 216 depending on the direction in which the fluid barrier 206 is to be moved. The proportional output solenoid valve 212 may also effect fluid communication between one of the fluid lines 214, 216 from which hydraulic fluid is to be directed to the inlet of the hydraulic fluid pump 210. Thus, movement of the fluid barrier 206 may be assisted by having suction from the inlet of hydraulic fluid pump 210 in fluid communication with the one of the fluid chambers 200A, 200B that is decreasing in volume with movement of the fluid barrier 206. As movement of the fluid barrier 206 displaces fluid from the corresponding one of the fluid chambers 200A, 200B. A proximity sensor 202, such as a magnetic field sensor, may be placed proximate each longitudinal end of the linear motor 201 such that movement of the fluid barrier 206 to a position proximate each longitudinal end of the linear motor 201 will be detected and communicated to a motor controller 215. In the event the fluid barrier 206 is moved proximate either longitudinal end of the linear motor 201, signals from the respective proximity detector 202 may be communicated to the motor controller 215 such that the proportional output solenoid valve 212 may be operated to reverse direction of motion of the fluid barrier 206 and thus the connecting rod 204.

Figure 2:
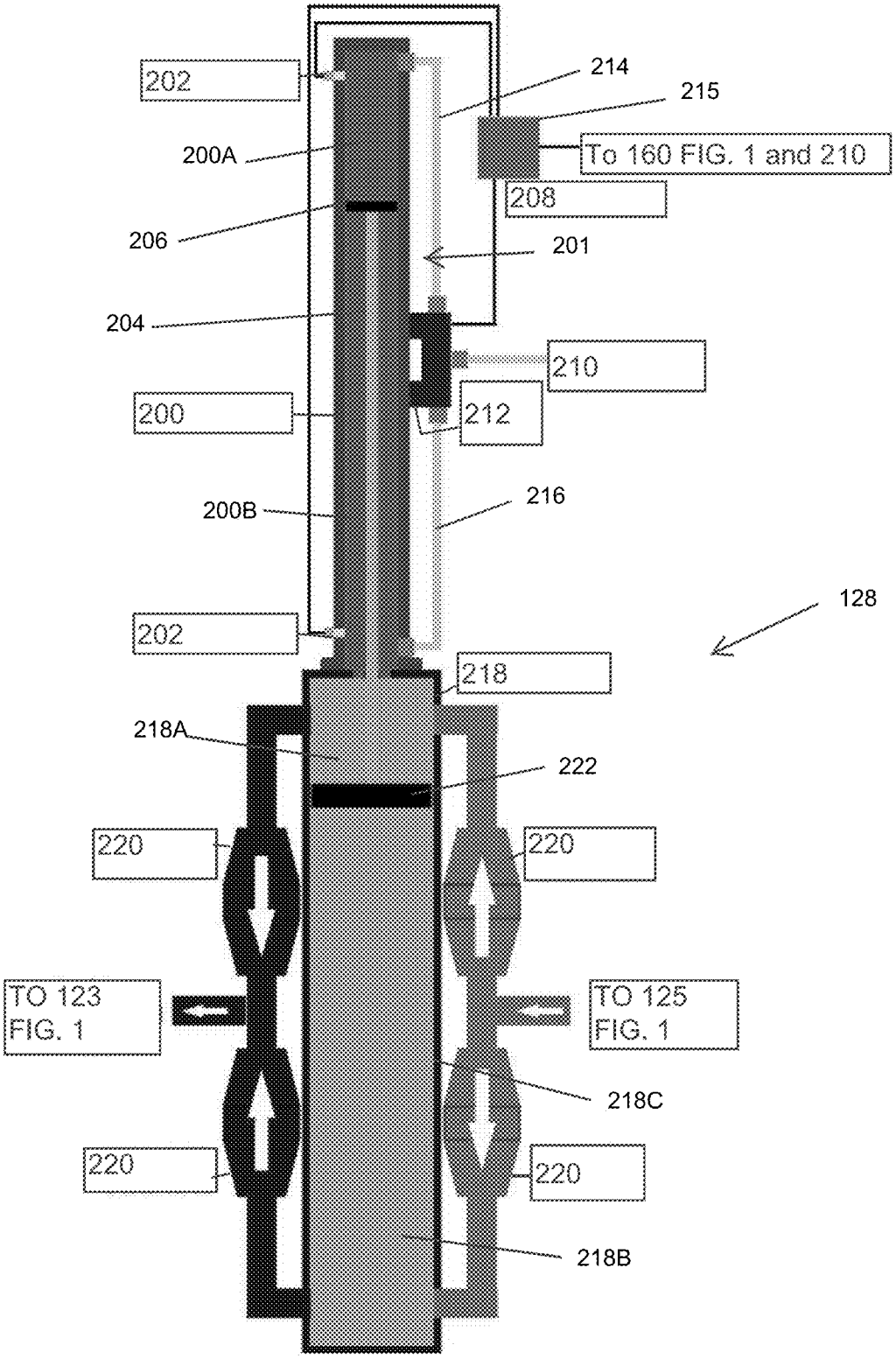
FIG. 2 shows a schematic diagram of one example embodiment of a pump according to the present disclosure.

The embodiment of a linear motor shown in FIG. 2 is only meant to serve as an example of linear motors that may be used with a backpressure pump in accordance with the present disclosure. Other embodiments of a linear motor may include, without limitation, a multiphase AC linear motor having multiphase stator windings and an armature connected to the connecting rod 204. Other embodiments of a linear motor may include an electric, pneumatic or hydraulic rotary motor having an output shaft coupled to a worm gear, and wherein a ball nut is coupled to the connecting rod 204.

In other embodiments, the embodiment of position sensors 202 which are proximity sensors may be substituted by a linear position sensor such as a linear variable differential transformer (LVDT).

In embodiments of a linear motor according to the present disclosure, a rate of movement of the linear motor 201 may be controlled by the motor controller 215 such that a selected fluid flow rate is provided by a fluid pump 218 operated by the connecting rod 204.

In the present example embodiment, the fluid pump 218 may be disposed proximate the linear motor 201 and may be substantially axially aligned with the linear motor 201. The fluid pump 218 may comprise an hydraulic cylinder 218C having therein a movable fluid barrier 222 such as a piston functionally coupled to the connecting rod 204. The movable fluid barrier 222 divides the hydraulic cylinder 218C into a first pumping chamber 218A and a second pumping chamber 218B. Movement of the connecting rod 204 by the linear motor 201 as explained above causes corresponding movement of the movable fluid barrier 222 in the hydraulic cylinder 218C to displace fluid from one of the pumping chambers 218A or 218B and to cause fluid to move into the other one of the pumping chambers 218B or 218A, depending on the direction of motion of the movable fluid barrier 222. Two, opposed one way valves 220, for example, passively actuated check valves, may be in fluid communication, respectively with a fluid source, e.g., the three way valve (125 in FIG. 1) to provide fluid to enter the respective pumping chamber 218A or 218B that is increasing in volume with movement of the movable fluid barrier 222 and to prevent back flow of such fluid to the fluid source from the other pumping chamber 218B or 218A. Correspondingly, one way valves 220 may be in fluid communication between each of the pumping chambers 218A, 218B to conduct discharge from the one of the pumping chambers 218A, 218B that is decreasing in volume as a result of motion of the movable fluid barrier 222 to the isolation valve (123 in FIG. 1), while preventing reverse flow of fluid back into the other one of the pumping chambers 218B, 218A.

In operation, a signal produced by the pressure sensor (121 in FIG. 1) is conducted to the controller (160 in FIG. 1). A difference between the pressure measured by the pressure sensor (160 in FIG. 1) and a selected well pressure will cause the controller (160 in FIG. 1) to generate a control signal proportional to the pressure difference. If the pressure difference is negative, the controller (160 in FIG. 1) may communicate a proportional control signal to the proportional output solenoid valve 212 to cause corresponding proportional rate movement of the fluid barrier 206, and thus movement of the movable fluid barrier. When the selected well pressure is reached, the controller (160 in FIG. 1) causes the proportional output solenoid valve 212 to close and correspondingly, the fluid barrier 206 immediately stops moving (zero wind down). Thus the illustrated embodiment of the backpressure pump 128 effectively delivers the precise amount of fluid and pressure required to maintain the well fluid pressure to the selected pressure substantially without any overshoot. Overshoot may cause the controller (160 in FIG. 1) to open the variable orifice choke (126 in FIG. 1) resulting in well pressure oscillations.

A backpressure pump according to the present disclosure may provide one or more of the following advantages compared to backpressure pumps known prior to the present disclosure:

The size of the backpressure pump is small in comparison to known backpressure pumps, in particular the amount of surface area occupied by the backpressure pump may be minimized by oriented the backpressure pump vertically. The length of conduit required to connect a backpressure pump according to the present disclosure to the well and to the fluid source is minimized. A backpressure pump according to the present disclosure would have suction capacity equal to its discharge capacity, therefore such a pump would not require a pre-charge pump in order to draw fluid over long distances. The power requirement for the linear motor to drive such backpressure pump is minimal. Because a backpressure pump according to the present disclosure few moving parts and operates only when needed, the cost to run and maintain it may be substantially less than known backpressure pumps. The simplicity of the design of the present backpressure pump makes possible repairs at the well location quickly and simply. In the embodiment shown in FIG. 2, seal rings on the fluid barrier 206 and a seal around the connecting rod 204 where it enters the hydraulic cylinder 218C are substantially the only items subject to substantial wear during operation of the backpressure pump. The one way valves 220, proportional output solenoid valve 212, and proximity sensors 202 are all commercially available items and to not require separate design and manufacturing. The simple design of the hydraulic cylinder 218C, wherein the one way valves 220 are disposed outside the hydraulic cylinder, requires only the most basic machining in order to build.

While a backpressure pump and well pressure control system have been described with respect to a limited number of embodiments, those skilled in the art, having benefit of this disclosure, will appreciate that other embodiments can be devised which do not depart from the scope of the present disclosure. Accordingly, the scope of the invention should be limited only by the attached claims.

What is claimed is:

1. An apparatus comprising:

a linear motor comprising a first hydraulic cylinder and a fluid barrier disposed therein, the first hydraulic cylinder being in selective fluid communication on opposed sides of the fluid barrier with a hydraulic fluid source;

a fluid pump functionally connected to the linear motor and comprising a fluid inlet and a fluid outlet, the fluid inlet configured to be in fluid communication with a fluid source, and the fluid outlet configured to be in fluid communication with a subsurface well;

a pressure sensor disposed outside of the subsurface well and in fluid communication with a fluid outlet of the subsurface well, the pressure sensor configured to measure a fluid pressure of the subsurface well and produce a signal corresponding to the fluid pressure of the subsurface well;

a controller functionally coupled to the linear motor and the pressure sensor, wherein the controller is configured to:

receive the signal corresponding to the fluid pressure from the pressure sensor;

determine a difference between the fluid pressure and a selected pressure of the subsurface well;

adjust an operation of the linear motor based on the difference between the fluid pressure and the selected pressure of the subsurface well; and stop the operation of the linear motor when the fluid pressure of the subsurface well is substantially equal to the selected pressure of the subsurface well; and a proportional output solenoid valve disposed between the hydraulic fluid source and the opposed sides of the fluid barrier, the proportional output solenoid valve being in signal communication with the controller to apply a proportional hydraulic pressure to one side of the fluid barrier related to the difference between the fluid pressure and the selected pressure of the subsurface well.

2. The apparatus of claim 1, wherein the fluid barrier is a piston functionally connected to the fluid pump via a connecting rod.

3. The apparatus of claim 2, further comprising at least one position sensor functionally coupled to the linear motor, the at least one position sensor generating a signal corresponding to a longitudinal position of the piston within the linear motor.

4. The apparatus of claim 2, further comprising a first position sensor disposed at a first end of the linear motor and a second position sensor disposed at a second end of the linear motor opposing the first end, wherein the first position sensor and the second position sensor each generate a signal corresponding to a longitudinal position of the piston within the linear motor.

5. The apparatus of claim 1, wherein the pressure sensor is in fluid communication with a fluid return conduit fluidly coupled to the fluid outlet of the subsurface well.

6. The apparatus of claim 1, wherein the fluid pump comprises a second hydraulic cylinder and a movable fluid barrier, the movable fluid barrier being functionally coupled to the linear motor.

7. The apparatus of claim 6, wherein the fluid pump comprises a one way valve in fluid communication between the fluid source and a respective fluid chamber defined by the movable fluid barrier in the second hydraulic cylinder.

8. The apparatus of claim 6, wherein the fluid pump comprises a one way valve in fluid communication between the subsurface well and a respective fluid chamber defined by the movable fluid barrier in the second hydraulic cylinder.

9. The apparatus of claim 1, wherein the linear motor and the fluid pump are arranged substantially vertically and in axial alignment.

10. A method comprising:

measuring a fluid pressure in a subsurface well with a pressure sensor disposed at a fluid outlet of the subsurface well;

determining a difference between the fluid pressure and a selected pressure of the subsurface well;

operating a linear motor functionally coupled to a fluid pump at a rate based on the difference between the fluid pressure and the selected pressure of the subsurface well, wherein the linear motor comprises a first hydraulic cylinder and a fluid barrier disposed therein, the first hydraulic cylinder being in selective fluid communication on opposed sides of the fluid barrier with a hydraulic fluid source, and wherein operating the linear motor comprises moving hydraulic fluid under pressure into the first hydraulic cylinder on one side of the fluid barrier, a rate of the moving hydraulic fluid under pressure being related to the rate of operating the linear motor;

operating a proportional output solenoid valve disposed between the hydraulic fluid source and the opposed sides of the fluid barrier to apply a proportional hydraulic pressure to one side of the fluid barrier related to the difference between the fluid pressure and the selected pressure of the subsurface well; and stopping operation of the linear motor when the fluid pressure is substantially equal to the selected pressure of the subsurface well.

11. The method of claim 10, wherein the fluid barrier is a piston functionally connected to the fluid pump via a connecting rod.

12. The method of claim 10, further comprising automatically reversing direction of movement of the linear motor when the piston in the linear motor approaches a longitudinal end of the linear motor.

13. The method of claim 12, wherein the piston approaching a longitudinal end of the linear motor comprises measuring proximity of the piston to the longitudinal end via a proximity sensor.

14. The method of claim 10, wherein the fluid pump comprises a second hydraulic cylinder and a movable fluid barrier, the movable fluid barrier of the fluid pump functionally coupled to the linear motor.

15. The method of claim 14, wherein the fluid pump comprises a fluid inlet and a fluid outlet, the fluid inlet of the fluid pump in fluid communication with a fluid source, and the fluid outlet of the fluid pump in fluid communication with the fluid outlet of the subsurface well.

16. The method of claim 15, further comprising constraining flow of fluid from the fluid source to an interior of the second hydraulic cylinder of the fluid pump via the fluid inlet only to a direction from the fluid source to the interior.

17. The method of claim 15, further comprising constraining flow of fluid from an interior of the second hydraulic cylinder of the fluid pump via the fluid outlet of the fluid pump only to a direction from the interior to the fluid outlet of the subsurface well.

18. An apparatus comprising:

a system for controlling pressure of a well during drilling operations, the system comprising:

a linear motor comprising a first hydraulic cylinder and a first fluid barrier disposed therein, the first hydraulic cylinder being in selective fluid communication on opposed sides of the first fluid barrier with a hydraulic fluid source;

a proportional output solenoid valve disposed between the hydraulic fluid source and the opposed sides of the first fluid barrier;

a fluid pump functionally connected to the linear motor and comprising a second hydraulic cylinder and a second fluid barrier disposed therein, the first fluid barrier being connected to the second fluid barrier via a connecting rod, the fluid pump comprising a fluid inlet and a fluid outlet, the fluid inlet being in fluid communication with a source of drilling fluid, and the fluid outlet being in fluid communication with the well;

a pressure sensor functionally coupled to the linear motor, the pressure sensor being configured to measure a fluid pressure of the well; and a controller functionally coupled to the linear motor and the pressure sensor, the controller being in signal communication with the proportional output solenoid valve and operable to communicate a proportional control signal to the proportional output solenoid valve to cause a corresponding proportional rate movement of the first fluid barrier and thereby cause a corresponding proportional flow rate of the drilling fluid output via the fluid outlet of the fluid pump.

* * * * *